US006131783A

United States Patent [19]

Maeng

[11] Patent Number: 6,131,783

[45] **Date of Patent: *Oct. 17, 2000**

[54] CARRIER BELT FOR GOLF BAG WITH ADJUSTABLE SHOULDER LOOP

[76] Inventor: Seop Maeng, 903-7 Gorim-RI Yongin-EUP, Yonging-Kun Kyungkido Seoul, Rep. of Korea

[ * ] Notice: This patent issued on a continued prosecution application filed under 37 CFR 1.53(d), and is subject to the twenty year patent term provisions of 35 U.S.C. 154(a)(2).

[21] Appl. No.: 08/918,683

[22] Filed: Aug. 21, 1997

[30] Foreign Application Priority Data

Aug. 23, 1996 [KR] Rep. of Korea ..... 96-25368
Aug. 23, 1996 [KR] Rep. of Korea ..... 96-25369

[51] Int. Cl.[7] ..... A45F 3/04

[52] U.S. Cl. ..... 224/645; 224/627; 206/315.3

[58] Field of Search ..... 224/627, 645, 224/259; 206/315.3

[56] References Cited

U.S. PATENT DOCUMENTS

| | | |
|---|---|---|
| 191,027 | 5/1877 | Case et al. . |
| D. 362,752 | 10/1995 | Steurer . |
| 950,452 | 2/1910 | Montgomery . |
| 990,837 | 5/1911 | Carlson . |
| 1,570,500 | 1/1926 | Kennedy . |
| 1,607,275 | 11/1926 | Hettrick . |
| 2,224,568 | 12/1940 | Altorfer . |
| 2,435,921 | 2/1948 | Cronrath . |
| 2,707,009 | 4/1955 | Cook . |
| 2,715,989 | 8/1955 | Sjodin et al. . |
| 2,820,498 | 1/1958 | Endee . |
| 2,853,111 | 9/1958 | Williams . |
| 2,864,361 | 12/1958 | Johnson . |
| 3,957,183 | 5/1976 | Gadberry . |
| 4,049,164 | 9/1977 | Sullivan . |
| 4,089,447 | 5/1978 | Achmetell . |
| 4,095,726 | 6/1978 | Hechler, IV et al. . |
| 4,318,502 | 3/1982 | Lowe et al. . |
| 4,431,121 | 2/1984 | Bensette . |
| 4,487,347 | 12/1984 | Zegar . |
| 4,561,578 | 12/1985 | Bell . |
| 4,630,763 | 12/1986 | Friedman . |
| 4,688,643 | 8/1987 | Carter . |
| 4,911,347 | 3/1990 | Wilhite . |
| 4,953,768 | 9/1990 | Muse . |
| 4,982,883 | 1/1991 | Ullal et al. . |
| 5,016,797 | 5/1991 | Rowledge . |
| 5,038,984 | 8/1991 | Izzo . |
| 5,042,703 | 8/1991 | Izzo . |
| 5,042,704 | 8/1991 | Izzo . |
| 5,184,764 | 2/1993 | Orovan et al. . |
| 5,348,205 | 9/1994 | Steurer ..... 224/645 |
| 5,540,365 | 7/1996 | LeMair . |
| 5,558,259 | 9/1996 | Izzo . |
| 5,636,778 | 6/1997 | Jones . |

*Primary Examiner*—Linda J. Sholl
*Attorney, Agent, or Firm*—Chapman & Cutler

[57] ABSTRACT

A golf bag includes a carrier belt attached to the golf bag's body which has a longitudinal axis and a closed end and an open end. A fixing strap has a first end attached to the bag body near the open end and a second end attached to the bag body at an intermediate position between the open end and the closed end. The fixing strap is substantially parallel to the longitudinal axis of the bag body. First and second shoulder straps are connected to the fixing strap and oriented generally in the same plane as the fixing strap, with each shoulder strap forming a loop into which a shoulder of a user is inserted. A moveable connector slideably attaches the first and second shoulder straps together. Upon movement of the connector, the relative sizes or shapes of the loops are changed.

8 Claims, 3 Drawing Sheets

CARRIER BELT FOR GOLF BAG WITH ADJUSTABLE SHOULDER LOOP

BACKGROUND OF THE INVENTION

1. Field of the Invention

The present invention relates to a carrier belt for a golf bag. More particularly it relates, to a carrier belt for a golf bag in which two shoulder straps are provided in the form of loops, with the sizes or shapes of the loops being adjusted by movement of a slideable connector which connects the shoulder straps together.

2. Description of the Prior Art

Conventionally, a carrier belt for the golf bag having a single strap structure has been used by a golfer or caddy to carry the golf bag. The single strap has one end attached near an open end of the golf bag and its other end attached to a mid-portion of the golf bag. The strap is hung on one shoulder of the user. However, there are several problems with the conventional carrier belt. For example, the single strap carrier belt has a structure for supporting the golf bag with only one shoulder of the user. Accordingly, since the golf bag has a weight of about 5 kg–10 kg with golf clubs inserted into the bag, when carrying the golf bag on one shoulder, the golfer may experience shoulder pain, thus making carrying the golf bag very laborious. Moreover, since the single carrier belt tends to shift off the shoulder of the user, the use of the carrier belt becomes even more difficult. To solve the above problems, a dual strap structure has been proposed. The control of the length of the carrier belt and the shape of the loops in these dual strap structures is not, however, convenient. That is, it is difficult to modify the dual strap carrier belt configuration in accordance with the physique of the user.

SUMMARY OF THE INVENTION

It is the objective of this invention to provide a detachable carrier belt for a golf bag with shoulder straps that may be conveniently adjusted in size to accommodate the physique of the user or allow the user to carry the bag on one or both shoulders.

This invention has several features, no single one of which is solely responsible for its desirable attributes. Without limiting the scope of this invention as expressed by the claims which follow, its more prominent features will now be discussed briefly. After considering this discussion, and particularly after reading the section entitled, "DETAILED DESCRIPTION OF THE PREFERRED EMBODIMENTS," one will understand how the features of this invention provide its benefits, which include low cost manufacture, convenience in use, and ease of adjustment of shoulder strap size.

A first feature of the carrier belt of this invention is that it may be used with a conventional golf bag body with a longitudinal axis and a closed end and an open end.

A second feature is that the carrier belt includes an elongated fixing strap with a first end attached to the bag body near the open end and a second end attached to the bag body at an intermediate position between the open end and the closed end. The fixing strap is substantially parallel to the longitudinal axis of the bag body, and it preferably includes a handle member along the fixing strap near the open end of the bag body. An advantage of this fixing strap is that it may be used as a handle, with the user grasping it anywhere along its length to balance the weight of the bag which varies depending on the number of clubs and accessories in the bag.

The third feature is that first and second shoulder straps are oriented generally in the same plane as the fixing strap. Each shoulder strap forms a loop into which a shoulder of a user is inserted. Preferably, the fixing strap and shoulder straps are made of fabric and are flexible.

A fourth feature is a moveable connector which slideably attaches the first and second shoulder straps together. Upon movement of the connector, the relative sizes or shapes of the loops are changed.

Two embodiment of the invention are disclosed. In a first embodiment of the carrier belt, a single elongated strap member is oriented generally in the same plane as the fixing strap. This single strap member has opposed ends, one of which is attached near the open end of the bag body and the other of which is attached near said intermediate position. The moveable connector slideably attaches an intermediate portion of the elongated strap member to the fixing strap to form the pair of loops. With the moveable connector located centrally along the fixing strap, the loops are approximately of equal size. Upon moving this connector towards the intermediate position, the loop adjacent the intermediate position deceases in size. Upon moving the connector towards the open end of the bag body, the size of the loop adjacent the open end deceases.

In a second embodiment, first and second strap members are connected to the fixing strap to be oriented generally in the same plane as the fixing strap. Each of the first and second strap members has opposed ends. Both ends of the first strap are attached near the open end of the bag body to form a first loop and both ends of the second strap are attached near the intermediate position to form a second loop. Intermediate portions of the first and second straps are secured together by the moveable connector which enables the sizes or shapes of the loops to be changed. Advantageously, one end of the strap connected near the open end may be detached and reconnected to the intermediate position. This increases the size of the first loop making it more convenient to carry the golf bag on only one shoulder of the user.

BRIEF DESCRIPTION OF THE DRAWINGS

The preferred embodiments of this invention, illustrating all its features, will now be discussed in detail. These embodiments depict the carrier belt of this invention as shown in the accompanying drawing, which is for illustrative purposes only. This drawing includes the following figures; with like numerals indicating like parts.

DETAILED DESCRIPTION OF THE PREFERRED EMBODIMENTS

Figure 1:
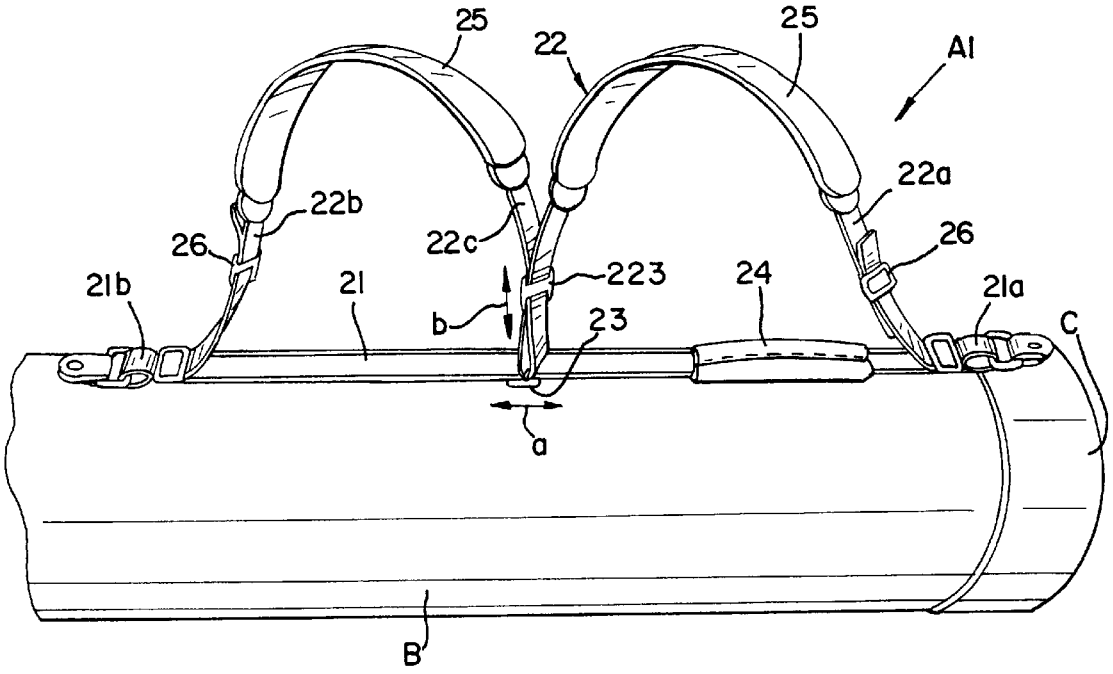
FIG. 1 is a perspective view of a golf bag using a carrier belt for according to the first embodiment of the present invention.
Figure 2:
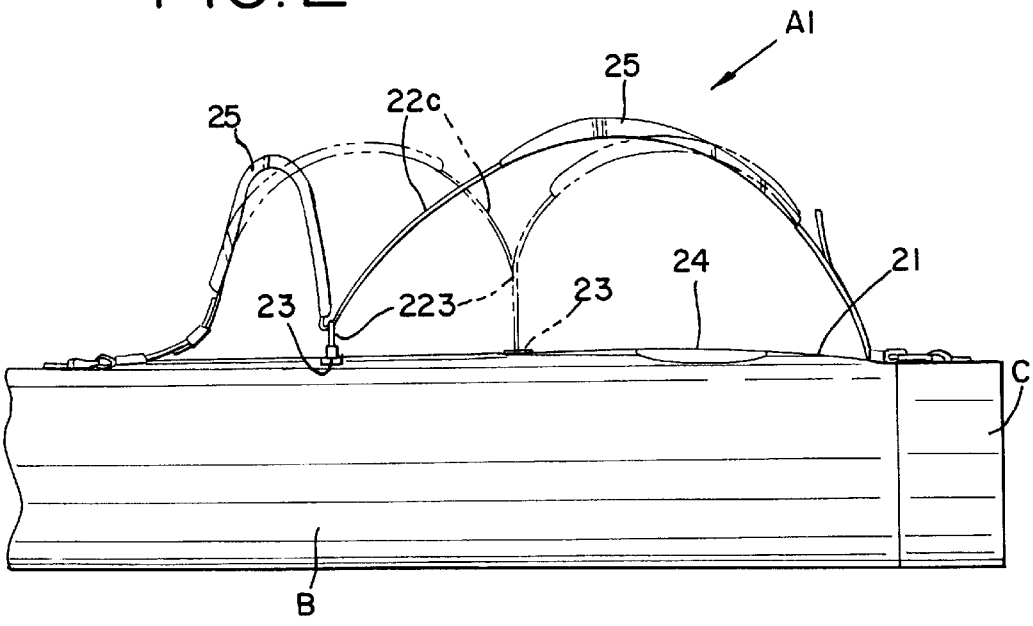
FIG. 2 is a side view showing the carrier belt according to the first embodiment of the present invention in a control state where the belt is adjusted for carrying on one shoulder.
Figure 3:
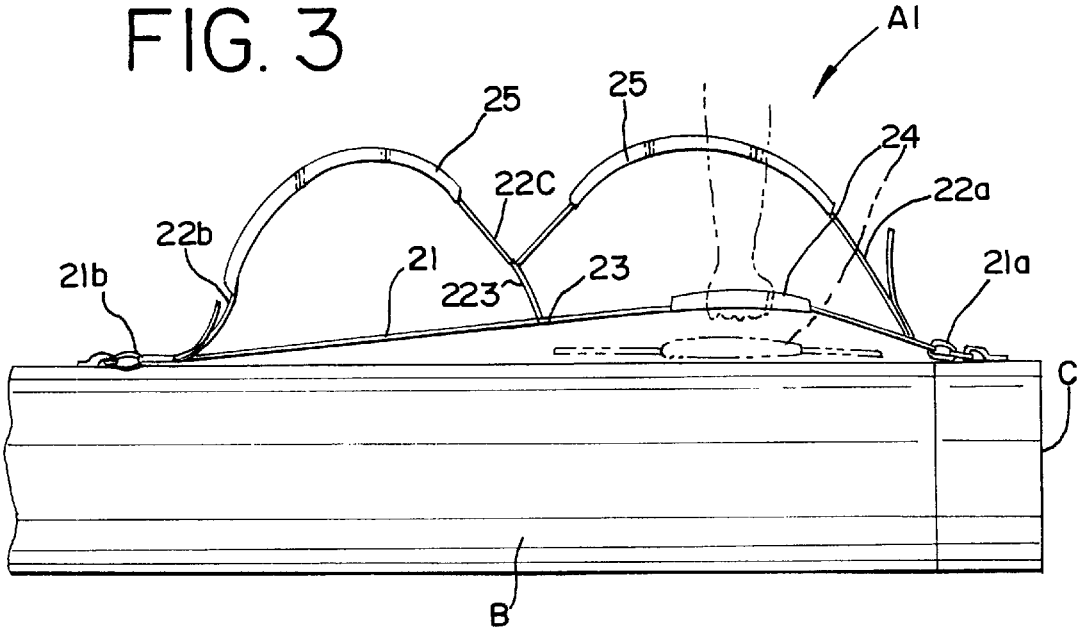
FIG. 3 is a side view showing a control state of the carrier belt according to the first embodiment of the present invention when the belt is grasped by a handle.

Referring to FIGS. 1 through 3, a carrier belt A1 according to the first embodiment of the present invention has a structure as follows. Opposed ends of a fixing strap 21 are fixed to a golf bag B, and the ends of a single, elongated shoulder pad member or strap 22 are fixed to the fixing strap 21. The mid-portion of the shoulder pad strap 22 is attached to a moveable fixing clip or connector 23. The fixing strap 21 has the shape of an elongated band and it is flexible and may be used as a handle, and the shoulder pad strap 22 has a two-humped shape providing two loops into which the shoulders of a user are inserted. An end 21*a* of the fixing strap 21 is connected at an open end C of the golf bag B and the other end 21*b* of the fixing strap 21 is detachably connected to an intermediate position between the open end C and a closed end (not shown) of the golf bag B. A handle 24 is formed on an portion of the fixing strap 21 adjacent the open end C. When lifting and carrying a golf bag B by hand, as shown in FIG. 3, a user can lift the golf bag B by the handle 24 with ease because the fixing strap 21 is maintained with a tension and the opposed ends 21*a* and 21*b* of the fixing strap 21 are fixed to the golf bag B. The strap 21, however, may be grasped at any position along its length as required to achieve balance.

The shoulder pad strap 22 includes end strips 22*a* and 22*b* fixed, respectively, to the opposed ends of the fixing strap 21, a right and left shoulder pad 25 connected to the end strips 22*a* and 22*b*, and a middle strip 22*c* connecting the shoulder pads 25. The fixing strap 21 and the shoulder pad strap 22 are connected together by a fixing connector 23 at their respective central portions. The fixing connector 23 can slide or move back and forth along the fixing strap 21 as indicated by an arrow a within a predetermined distance determined by the size of the pads 25. In this embodiment, both ends 21*a* and 21*b* of the fixing strap 21 are connected, respectively, to the ends 22*a* and 22*b* of the shoulder pad strap 22 by means of buckles 26. Another slideable fixing clip 223 is moveably mounted to a mid-portion of the shoulder pad strap 22 on the middle strip 22*c* to move towards and away from the body of the golf bag B as indicated by the arrow b. The middle strip 22*c* forms a loop which is attached to the slideable fixing connector 23, and the opposed sides of the slideable fixing connector 23 forming the loop pass through the slideable fixing connector 223. As depicted in FIG. 2, when the fixing connector 23 is moved, the fixing connector 223 also moves simultaneously.

When carrying the golf bag B on both shoulders, the user first adjusts the position of the fixing connector 23 generally centrally as shown in FIG. 1 in order to have proper size loops capable of hanging one shoulder pad 25 on each shoulder of the user. Thus, the user can carry the golf bag with ease. When hanging a golf bag B on only one shoulder, the user selects which one of the two shoulder pads 25 to use and adjusts the loop size accordingly as shown in FIG. 2.

Specifically, if the user selects the shoulder pad 25 to the right as view in FIG. 2 to carry the bag, the fixing connector 23 is moved to the left along the fixing strap 21 and the middle strip 22*c* slides through the fixing connector 223, with the raised portion of the left pad 25 acting as a stop to limit the movement of the fixing connectors 23 and 223. As shown in solid lines in FIG. 2, this movement of the fixing connectors 23 and 223 changes the relative sizes of the loops to enlarged the loop on the right and to decrease the size of the loop on the left. The full length of the middle strip 22*c* is now added to the length of the right pad 25 and the end strips 22*a* to form the enlarged right side loop. To increase the size of the left loop the direction of movement of the fixing connector 23 is reversed to decrease the size of the right loop and increase the size of the left loop.

According to this first embodiment of the present invention, there are several effects that a user can select. He or she may use either the right or left shoulder pad 25 and adjust the fixing connector 23 to the right or left as desired so the bag may conveniently be carried on one shoulder of the user. Or, adjust the position of the fixing connector 23 so that the golf bag B may be carried on both shoulders. Moreover, the golf bag can be carried by the 24 handle without adjusting the tension of the fixing strap 21. In other words, it is not necessary to mount the handle in a complicated fashion. Although the center of gravity of the golf bag B is changed by the number of clubs it holds, when carrying the bag B with one hand, the user may easily and conveniently adjusted for this change by positioning his or her hand anywhere along the length of the fixing strap 21 to achieve balance.

Figure 4:
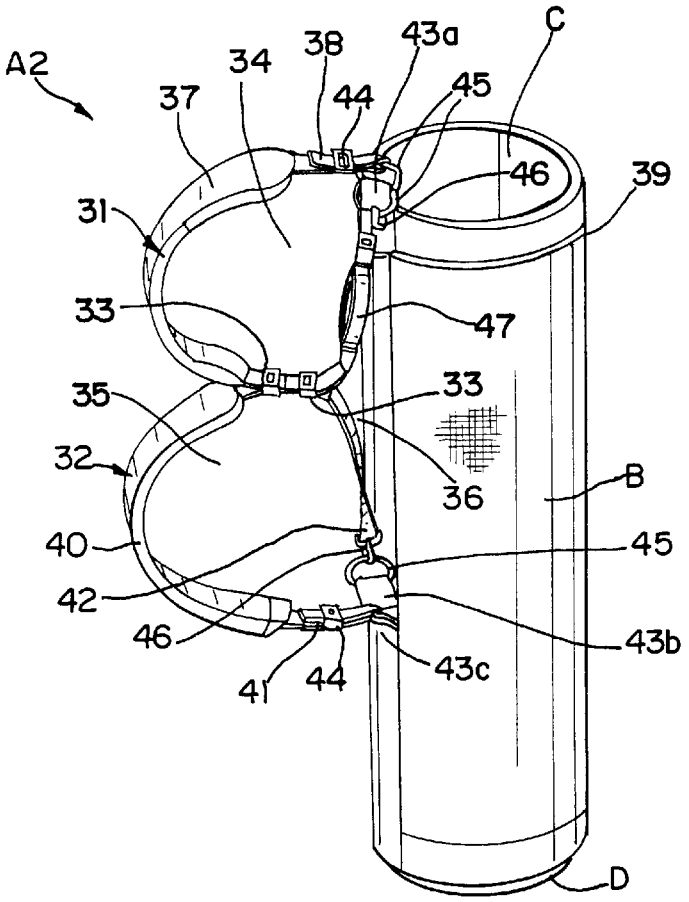
FIG. 4 is a perspective view showing a carrier belt for the golf bag according to the second embodiment of the present invention, attached to a golf bag.
Figure 5:
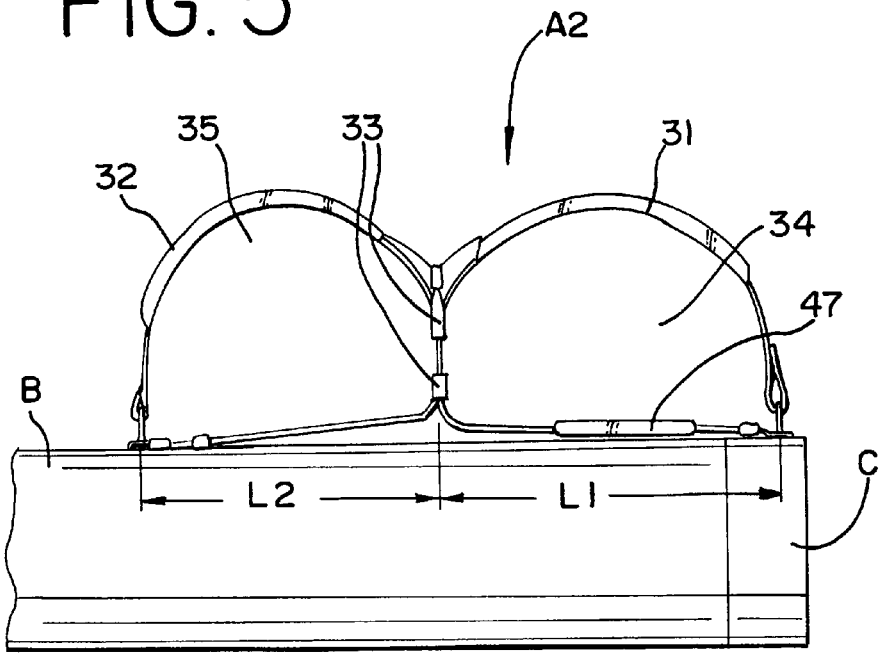
FIG. 5 is a side view showing the carrier belt according to the second embodiment in a hanging state for placement on both shoulders of a golfer or caddy.
Figure 6:
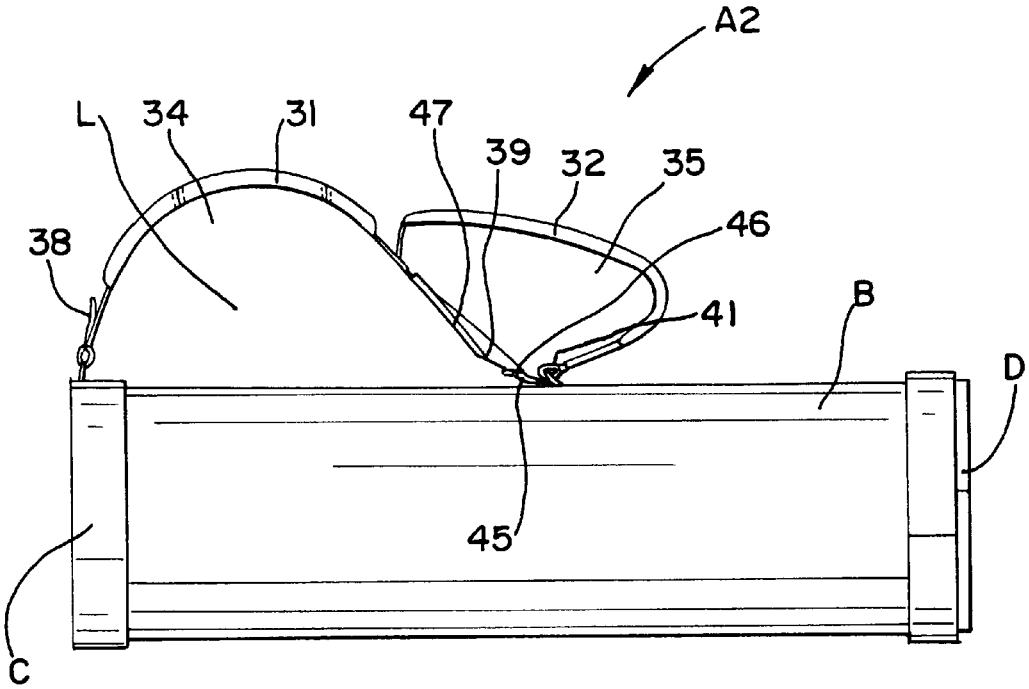
FIG. 6 is a side view showing the carrier belt according to the second embodiment in a hanging state for placement on one shoulder of a golfer or caddy.

Referring to FIGS. 4 through 6, a carrier belt A2 according to the second embodiment of the present invention has a structure as follows. As shown in FIG. 4, one shoulder pad strap 31 has both its opposed ends detachably connected to the golf bag B near the open end C of the golf bag B, and another shoulder pad strap 32 has both its opposed ends detachably connected to a central, intermediate position between the open end C and the closed end D of the golf bag B. A pair of connectors 33 are slideably mounted on an intermediate portion of both pad straps 31 and 32 in order to connect these straps together and adjust the configuration of the loops 34 and 35 formed by the pad straps 31 and 32. In this embodiment of the carrier belt A2, the loop 34 defined by the one pad member 31 hangs on one shoulder of a user, and the loop 35 defined by the other pad member 32 hangs on the other shoulder of the user. There is a space 36 formed by the portions of the pad strap 31 and 32 near a side of the golf bag B and the side of the golf bag B.

The one pad strap 31 includes a shoulder pad 37 and end strips 38 and 39 connected, respectively, to the opposed ends of the shoulder pad 37. The other shoulder pad strap 32 includes a shoulder pad 40 and end strips 41 and 42 connected, respectively, to opposed ends of the shoulder pad 40. A pair of rings 45, 45 are positioned the open end C of the bag clip 46 at the end of strip 39 is detachably connected to one ring 45 and a looped end of the strip 38 is secured to the other ring 45 and detachably held in position by a buckle 44. There also are a pair of rings 45 at the intermediate position of the bag B, A clip 46 at the end of strip 42 is detachably connected to one ring 45 and a looped end of the strip 41 is secured to the other ring 45 and detachably held in position by a buckle 44. Although two rings 45 are employed at each position where the ends of the shoulder pad straps 31 and 32 are to be attached, only one fixing ring may be used at each position. The strips 39 and 42 of the first strap 31 form an elongated handle member when the shoulder pads straps 31 and 32 are connected as shown in FIG. 4. A handle 47 is attached to the strip 39 of the one pad strap 31 adjacent to the side of the golf bag B, but the user may carry the bag with one hand by grasping either strip 39 or 42 anywhere along their lengths to achieve balance.

In this embodiment, although two connectors 33 are illustrated, one may use only one connector. When the connector 33 adjacent the side of the golf bag B is moved towards the side of the bag body, the space 36 is reduced and the tension in the strip 39 is increased, so the strips 39 and 42 forming the handle structure are tightened. Upon moving the connector 33 adjacent the side of the bag body away from the side of the bag body, according to the center of gravity of the golf bag, the tension in the strip 39 and the position of the handle 47 is changed. The connector 33 farther from the side of the bag can be moved towards and away from the side of the bag body, thereby altering the shape of the loops 34 and 35. In other words, movement of the other connector 33 displaced furthest from the bag body, changes the width of the remote portions of the pad straps 31 and 32. Accordingly, the size of the loops 34 and 35 can be adjusted to fit the shoulder width of the user.

When carrying the golf bag B on both shoulders, the user first hangs one pad strap 31 on one shoulder, so the bag body rests on the back of the user, and then the user hangs the other pad strap 32 on the other shoulder, so the shoulder pads 31 and 32 sit on both shoulders, thereby enabling the user to easily carry the golf bag B. That is, when the user inserts one hand into the one loop 34, the golf bag B is positioned next to the back of the user, and then the user inserts the other arm into the other loop 35. When the user hangs the golf bag on both shoulders, the golf bag is stable, and the carrier belt A2 can be an adjusted according to his or her physical conditions.

FIG. 6 depicts the change in position of the pad strap 31 when hanging the golf bag B on only one shoulder. The pad strap 31 is repositioned from that shown in FIGS. 4 and 5 by the user's disconnecting clip 46 and reconnecting it to the ring 45 at the intermediate position between the open end C and closed end D of the golf bag B, so that a big size loop L is formed, thereby enabling the user to easily hang the golf bag B on one shoulder.

When lifting and carrying a golf bag by the handle 47 or any where along the lengths of the strips 39 and 42, the user adjusts the connector 33 adjacent the side of the bag body, so the portions of the pad straps 31 and 32 adjacent the bag body are positioned nearly along a straight line and the lengths L1 and L2 are about equal as shown in FIG. 5. The user can now easily hold the handle 47 or any portion of the strips 39 and 42, so lifting and carrying of the golf bag becomes easy. In this embodiment, the center of gravity of the golf bag B is changed according to the number of clubs (not shown) inserted into the golf bag B. If the number of golf clubs increases, the center of gravity is moved toward the end C of the golf bag B. To compensate for this, the user may also adjust the length of the upper pad strap by means of changing position of the the buckle 44, so that the position of a handle 47 is changed back and forth, thereby enabling the user to easily carry the golf bag.

According to the second embodiment of the present invention, there are several effects. Since two separated loops 34 and 35 are formed, one near the end C and the other near the intermediate position, the manufacture and a use of a shoulder pad capable of hanging on both shoulders becomes easy, and adjusting the tension of the upper and lower pad straps 31 and 32 is easy by means of the connectors 33. This second embodiment is convenient to use, since the one end of the shoulder pad strap 31 is easily unlocked and attached to another ring at the intermediate position, or vice versa, a user can easily hang the golf bag B on one shoulder or reconnect the straps to configure them for carrying the golf bag on both shoulders. Since the handle 47 is formed or attached to the one pad strap 31, carrying the bag by the handle or by the strips 39 and 42 becomes easy even without using a handle having a complicated structure.

SCOPE OF THE INVENTION

The above presents a description of the best mode contemplated of carrying out the present invention, and of the manner and process of making and using it, in such full, clear, concise, and exact terms as to enable any person skilled in the art to which it pertains to make and use this invention. This invention is, however, susceptible to modifications and alternate constructions from that discussed above which are fully equivalent. Consequently, it is not the intention to limit this invention to the particular embodiments disclosed. On the contrary, the intention is to cover all modifications and alternate constructions coming within the spirit and scope of the invention as generally expressed by the following claims, which particularly point out and distinctly claim the subject matter of the invention:

What is claimed is:

1. A golf bag with adjustable carrier straps comprising:

a bag body having a longitudinal axis and a closed end and an open end and an intermediate position spaced between them along the axis, first and second strap members connected to the bag body and oriented generally in the same plane as the longitudinal axis of the bag body, each of said first and second strap members having opposed ends, both ends of the first strap being attached near the open end of the bag body to form a first loop and both ends of the second strap being attached near the intermediate position of the bag body to form a second loop, and intermediate portions of said first and second straps being secured together by a connector, and said first strap having only one of the ends that are connected near the open end of the golf bag being readily detachable from the position of the other end and then readily reconnected near said intermediate position to increase the size of the first loop, leaving the other one of the ends of the first strap attached near the open end of the golf bag, making it more convenient to carry the golf bag on only one shoulder of the user.

2. The golf bag of claim 1 where the connector is moveable to enable the shapes of the loops to be changed.

3. The golf bag of claim 2 where the connector is moveable towards and away from the bag body.

4. The golf bag of claim 1 including a handle member along the first strap near said open end of the bag body.

5. A carrier belt adapted to be connected to a golf bag, the golf bag having a bag body with a longitudinal axis and a closed end and an open end and an intermediate position between the ends, said carrier belt comprising:

first and second strap members adapted to be connected to the bag body and oriented generally in the same plane as the longitudinal axis of the bag body, each of said first and second strap members having opposed ends, both ends of the first strap adapted to be attached near the open end of the bag body to form a first loop and both ends of the second strap adapted to be attached near said intermediate position of the bag body to form a second loop, and intermediate portions of said first and second straps being secured together by a connector, and said first strap having only one of its ends adapted to be connected near the open end of the golf bag being readily detachable from near the open end of the bag and readily connected alternatively near said intermediate position of the bag to increase the size of the first loop, while the other one of the ends remains connected near the open end of the golf bag, making it more convenient to carry the golf bag on only one shoulder of a user.

6. The carrier belt of claim 5 including a handle member along the first strap near said open end of the bag body.

7. The carrier belt of claim 5 where the connector is moveable to enable the shapes of the loops to be changed.

8. The carrier belt of claim 7 where the connector is moveable towards and away from the bag body.

* * * * *